US010865040B2

(12) United States Patent
Oltman et al.

(10) Patent No.: US 10,865,040 B2
(45) Date of Patent: Dec. 15, 2020

(54) PORTABLE TANK

(71) Applicant: SNYDER INDUSTRIES, INC., Lincoln, NE (US)

(72) Inventors: Darrell A. Oltman, Lincoln, NE (US); Larry D. Thomas, Beatrice, NE (US)

(73) Assignee: SNYDER INDUSTRIES, LLC, Lincoln, NE (US)

( * ) Notice: Subject to any disclaimer, the term of this patent is extended or adjusted under 35 U.S.C. 154(b) by 382 days.

(21) Appl. No.: 15/291,557

(22) Filed: Oct. 12, 2016

(65) Prior Publication Data

US 2017/0275093 A1 Sep. 28, 2017

Related U.S. Application Data

(60) Provisional application No. 62/312,280, filed on Mar. 23, 2016.

(51) Int. Cl.
*B65D 90/04* (2006.01)
*B65D 90/10* (2006.01)
(Continued)

(52) U.S. Cl.
CPC ..... *B65D 90/10* (2013.01); *B65D 88/022* (2013.01); *B65D 90/0033* (2013.01); *B65D 90/14* (2013.01); *B65D 2588/125* (2013.01)

(58) Field of Classification Search
CPC .... B65D 90/04; B65D 90/041; B65D 90/044; B65D 90/10; B65D 90/105; B65D 90/34;
(Continued)

(56) References Cited

U.S. PATENT DOCUMENTS 3,140,006 A * 7/1964 Nelson ..... F17C 1/04 220/587
3,268,103 A * 8/1966 Nelson ..... B65D 90/044 220/586

(Continued)

*Primary Examiner* — Allan D Stevens
(74) *Attorney, Agent, or Firm* — Hovey Williams LLP

(57) ABSTRACT

A tank for bulk material storage and transport and method for producing same. In an embodiment, a tank is provided that includes a shell having a sidewall, a neck including a first collar, and a tube terminating in a second collar. A frustoconical cap may be secured to the first collar. A substantially conical cap may be secured to the second collar. A liner may be applied to the shell so that the liner substantially covers an interior surface of the sidewall, an interior surface of the neck, at least a portion of the first collar, an interior surface of the tube, and at least a portion of the second collar. Annular thickened segments may be trimmed to prepare the tank for use. The annular thickened segments may be located at an interior joint between the frustoconical cap and the first collar, and/or an interior joint between the substantially conical cap and the second collar. The trimming step may form first and second sealing surfaces of the liner adjacent respectively to the first and second collars. The first and second sealing surfaces may respectively be configured to substantially seal against a manway cover and an outlet cover. In a final, assembled preferred form, the frustoconical and substantially conical caps are replaced with the manway assembly and outlet cover, respectively sealed against the first and second sealing surfaces.

9 Claims, 10 Drawing Sheets

(51) Int. Cl.
*B65D 90/00* (2006.01)
*B65D 90/14* (2006.01)
*B65D 88/02* (2006.01)

(58) Field of Classification Search
CPC ..... B65D 90/042; F16J 13/00; F16J 13/02; F17C 2203/0604; F17C 2203/0607; F17C 2205/0323; F17C 2205/0332; F17C 2205/0335; F17C 2205/0338
USPC ..... 220/586
See application file for complete search history.

(56) References Cited

U.S. PATENT DOCUMENTS

| | | | | | |
|---|---|---|---|---|---|
| 3,604,587 | A * | 9/1971 | Pechacek | B21D 51/24 | 220/587 |
| 4,699,294 | A * | 10/1987 | Carlin, Jr. | B29C 41/20 | 220/319 |
| 5,346,090 | A * | 9/1994 | Purohit | B01J 3/04 | 220/23.87 |
| 2004/0194846 | A1* | 10/2004 | Sone | B32B 1/02 | 141/65 |
| 2007/0012551 | A1* | 1/2007 | Rohwer | F17C 13/04 | 200/61.22 |
| 2011/0114651 | A1* | 5/2011 | Oltman | F16L 5/08 | 220/661 |
| 2012/0267371 | A1* | 10/2012 | Ireland | B65D 90/10 | 220/256.1 |
| 2017/0029620 | A1* | 2/2017 | Sato | C08L 23/26 | |

* cited by examiner

PORTABLE TANK

RELATED APPLICATIONS

This Patent Application claims priority to U.S. Patent Application Ser. No. 62/312,280 filed Mar. 23, 2016, and titled PORTABLE TANK, the contents of which is incorporated herein by reference in its entirety.

BACKGROUND OF THE INVENTION

1. Field of the Invention

The present invention relates to tanks for bulk material storage and transport and methods of making such tanks. The present invention more particularly relates to an improved tank having improved interior liner coverage and/or peripheral components.

2. Discussion of the Prior Art

Tanks employed for the storage and transportation of bulk materials, such as chemicals, may include a liner (e.g., a thermoplastic liner) that is often intended to reduce chemical reaction between the stored materials and the main structural component of the tank (such as a stainless steel shell or frame). It is known to include an inner liner configured as an un-adhered internal bladder that may expand and contract, at least to some extent, independently of its shell. It is also known to adhere such a liner to the inner surface of the shell. However, existing tanks are not optimized for maximum liner coverage of all surfaces inside or at the periphery of the shell and/or may have points of exposure, particularly at points of tank access, that compromise the integrity of the container. There is therefore a need for an improved tank for bulk material storage and transport having improved interior liner coverage and/or peripheral components.

This background discussion is intended to provide information related to the present invention which is not necessarily prior art.

SUMMARY

Embodiments of the present invention address the above-described and other problems and limitations by providing an improved storage and transport tank. In one implementation, the present invention accomplishes this with a shell configured to be lined and secured to peripheral components to form a tank with improved lining and tank access characteristics.

According to one aspect of the present invention, a tank includes a shell having a sidewall that defines an interior cavity, a top having a neck including a first collar, and a bottom having a tube including a second collar, the neck and the tube being in fluid communication with the interior cavity of the shell. The tank also includes a liner substantially covering an interior surface of the sidewall, top and bottom, including covering at least a portion of the first collar and at least a portion of the second collar. The tank also includes a manway cover configured to substantially seal against the portion of the liner covering the first collar. The tank also includes an outlet cover configured to form a substantial seal by being fixed to the second collar.

According to another aspect of the present invention, an intermediate production-stage tank includes a shell having a sidewall that defines an interior cavity, a top having a neck including a first collar, and a bottom having a tube including a second collar, the neck and the tube being in fluid communication with the interior cavity. The tank also includes a liner substantially covering an interior surface of the sidewall, top and bottom, including covering at least a portion of the first collar and at least a portion of the second collar. The tank also includes a frustoconical cap secured to the first collar and a substantially conical cap secured to the second collar. The liner forms an annular thickened segment at each of an interior joint between the frustoconical cap and the first collar and an interior joint between the substantially conical cap and the second collar. To prepare the intermediate production-stage tank for use, among other things the annular thickened segments are trimmed to form first and second sealing surfaces along the first and second collars.

According to another aspect of the present invention, a method for producing a tank for material storage and transport includes providing a shell having a sidewall, a top having a neck including a first collar, and a bottom including a tube having a second collar. The method also includes securing a frustoconical cap to the first collar and securing a substantially conical cap to the second collar. The method also includes applying a liner to the shell so that the liner substantially covers an interior surface of the sidewall, top and bottom, including covering at least a portion of the first collar and at least a portion of the second collar. The method also includes trimming away an annular thickened segment at each of an interior joint between the frustoconical cap and the first collar and an interior joint between the substantially conical cap and the second collar. The trimming step forms first and second sealing surfaces of the liner adjacent respectively to the first and second collars. The first and second sealing surfaces are respectively configured to substantially seal against a manway cover and an outlet cover in a completed tank.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 1:
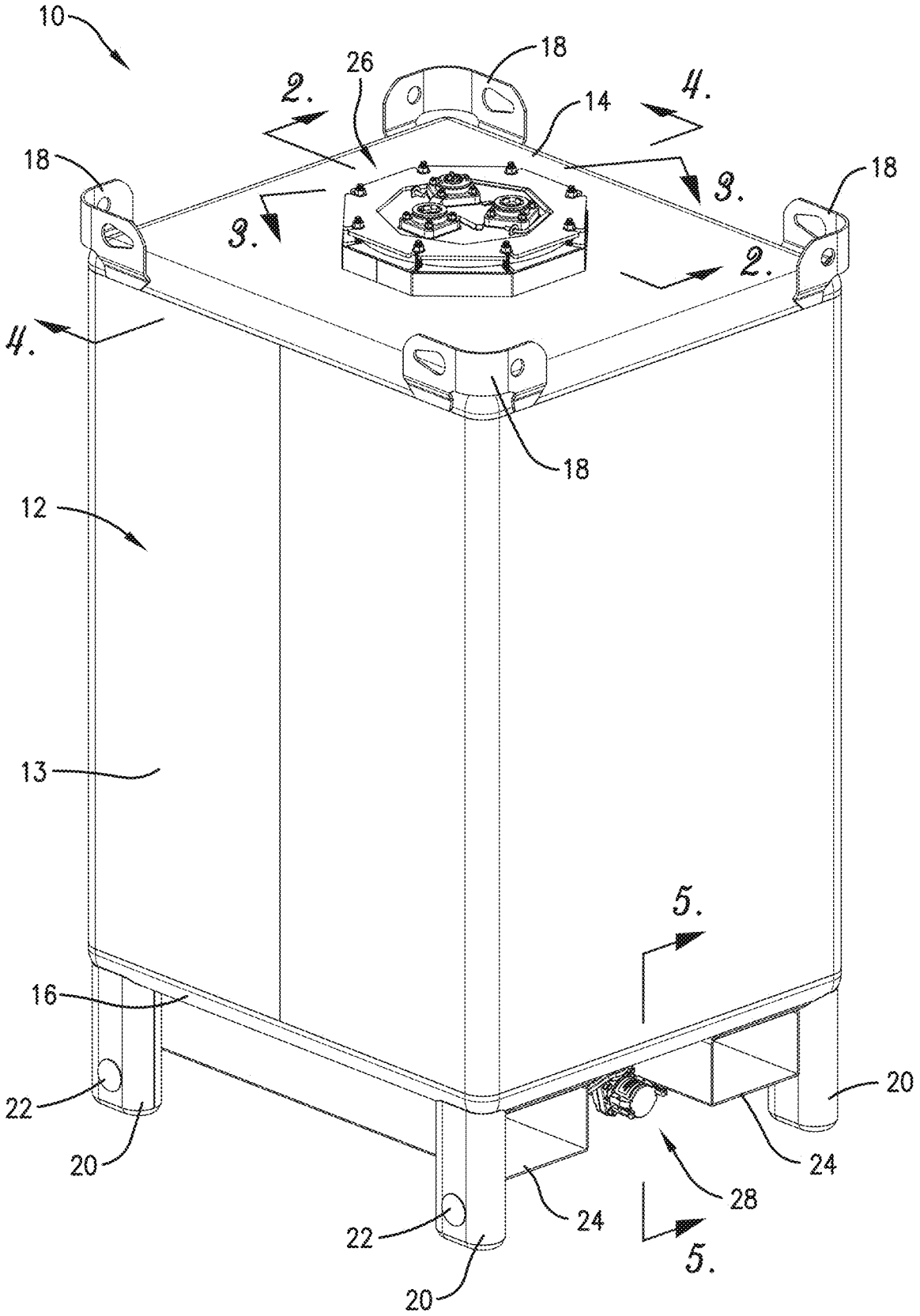
FIG. 1 is a front perspective view of a finished storage and transport tank constructed in accordance with a first preferred embodiment of the present invention.
Figure 9:
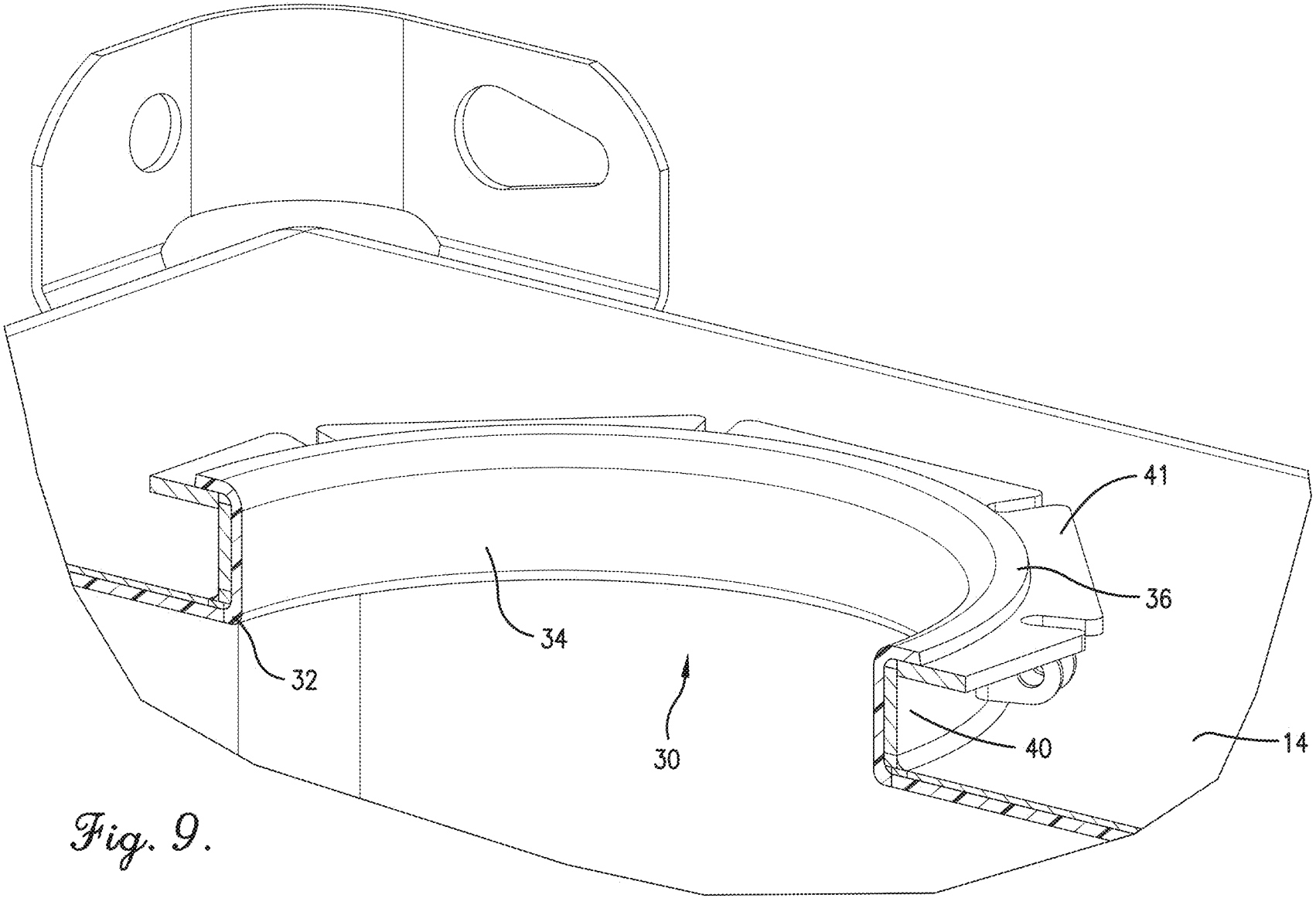
Figure 10:
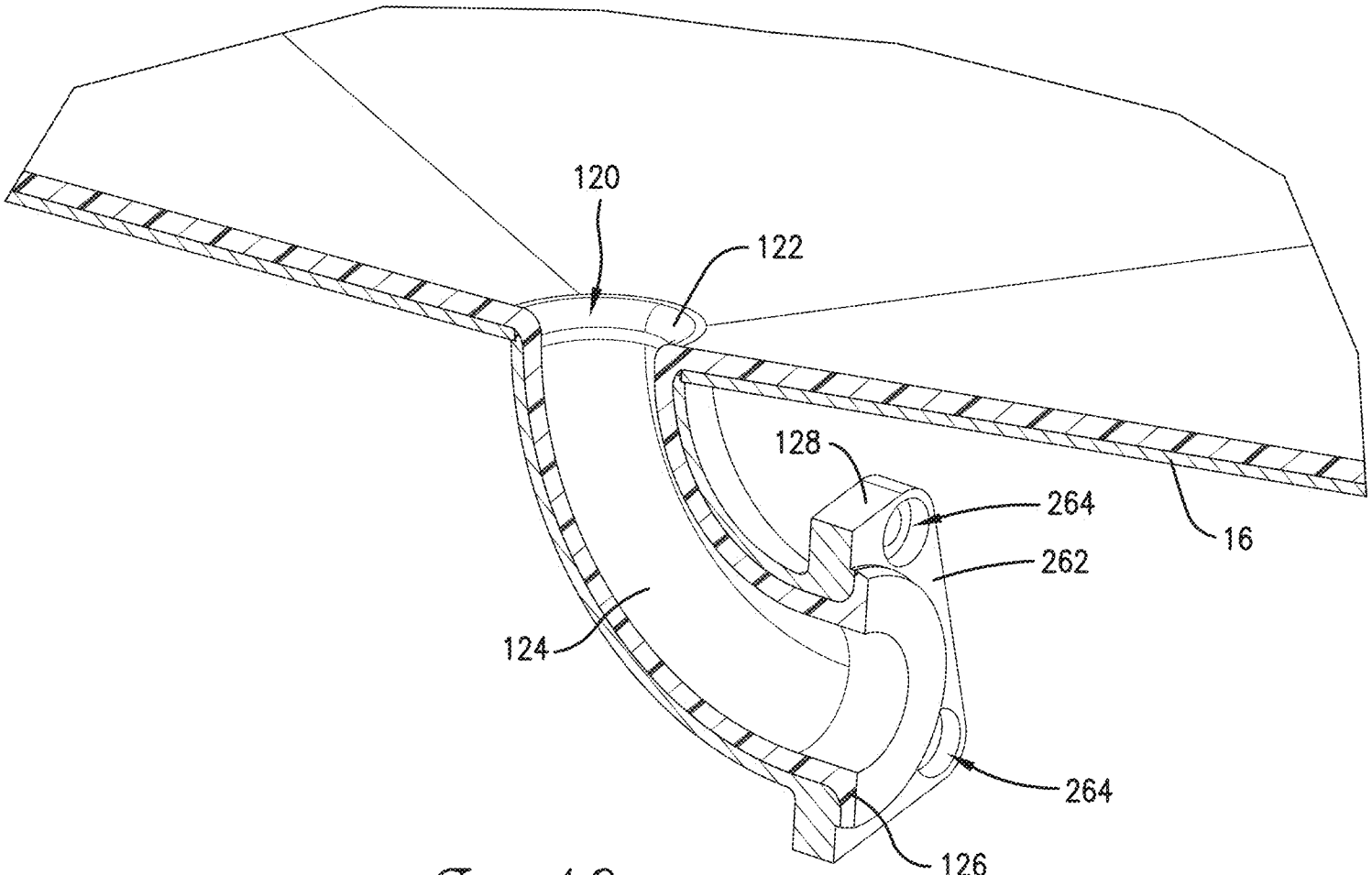

FIG. 9 is partial sectioned perspective view of the finished tank of FIG. 1, taken along a centerline of the tank with manway assembly removed, and illustrating a portion of the liner covering a collar of the neck and having been trimmed of its thickened annular segment to form a first sealing surface; and FIG. 10 is partial sectioned perspective view of the finished tank of FIG. 1, taken along a centerline of the tank with outlet cover removed, and illustrating a portion of the liner covering a collar of the tube and having been trimmed of its thickened annular segment to form a second sealing surface.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

In this description, references to "one embodiment", "an embodiment", or "embodiments" mean that the feature or features referred to are included in at least one embodiment of the invention. Separate references to "one embodiment", "an embodiment", or "embodiments" in this description do not necessarily refer to the same embodiment and are not mutually exclusive unless so stated. Specifically, a feature, structure, act, etc. described in one embodiment may also be included in other embodiments, but is not necessarily included. Thus, particular implementations of the present invention can include a variety of combinations and/or integrations of the embodiments described herein.

Furthermore, directional references (e.g., top, bottom, front, back, up, down, etc.) are used herein solely for the sake of convenience and should be understood only in relation to each other. For instance, a component might in practice be oriented such that faces referred to as "top" and "bottom" are sideways, angled, inverted, etc. relative to the chosen frame of reference.

It is also noted that, as used herein, the terms "axial," "axially," and variations thereof mean the defined element has at least some directional component along or parallel to the axis. These terms should not be limited to mean that the element extends only or purely along or parallel to the axis. For example, the element may be oriented at a forty-five degree (45°) angle relative to the axis but, because the element extends at least in part along the axis, it should still be considered axial. Similarly, the terms "radial," "radially," and variations thereof shall be interpreted to mean the element has at least some directional component in the radial direction relative to the axis.

It is further noted that the term "annular" shall be interpreted to mean that the referenced object extends around a central opening so as to be generally toroidal or ring-shaped. It is not necessary for the object to be circular, nor does the object have to be continuous. Similarly, the term "toroidal" shall not be interpreted to mean that the object must be circular or continuous.

Turning now to the Figures, FIG. 1 illustrates a tank 10 configured to store and transport materials, such as chemicals, in bulk. Tank 10 includes a shell or bin 12. Shell 12 includes a sidewall 13, top or top head 14, and bottom 16. The tank 10 also includes lift lugs 18 fixed to the shell 12 at the joint between the top 14 and the sidewall 13. Lift lugs 18 are configured to be secured to a hoist or crane or the like for lifting of the tank 10, and are preferably fixed to the shell 12 during fabrication using a welding process.

The tank 10 further includes legs 20 for supporting the tank 10 in an upright standing position. Legs 20 include apertures 22. Apertures 22 may serve as points of engagement between the tank 10 and machinery—for example of the type used in rotational molding—that is used to physically adjust the tank 10 during application of the liner. More particularly, the apertures 22 may provide surfaces for engagement between the tank 10 and a mounting frame (not shown). The mounting frame may, in turn, be fixed (permanently or removably) to a rotational molding machine (not shown) by, for example, J-bolts or similar fasteners. The rotational molding machine may rotate tank 10 biaxially while liner is applied, causing even movement and distribution of liner inside the tank 10.

The tank also includes pockets 24 adjacent the legs 20 for receiving and slidably enclosing forks of a forklift, enabling the tank 10 to be relocated via the forklift. The tank 10 also includes a manway assembly 26 along the top 14 of the shell 12, and an outlet cover 28 (shown as a bottom drain valve attached to an outlet port) along the bottom 16.

Figure 2:
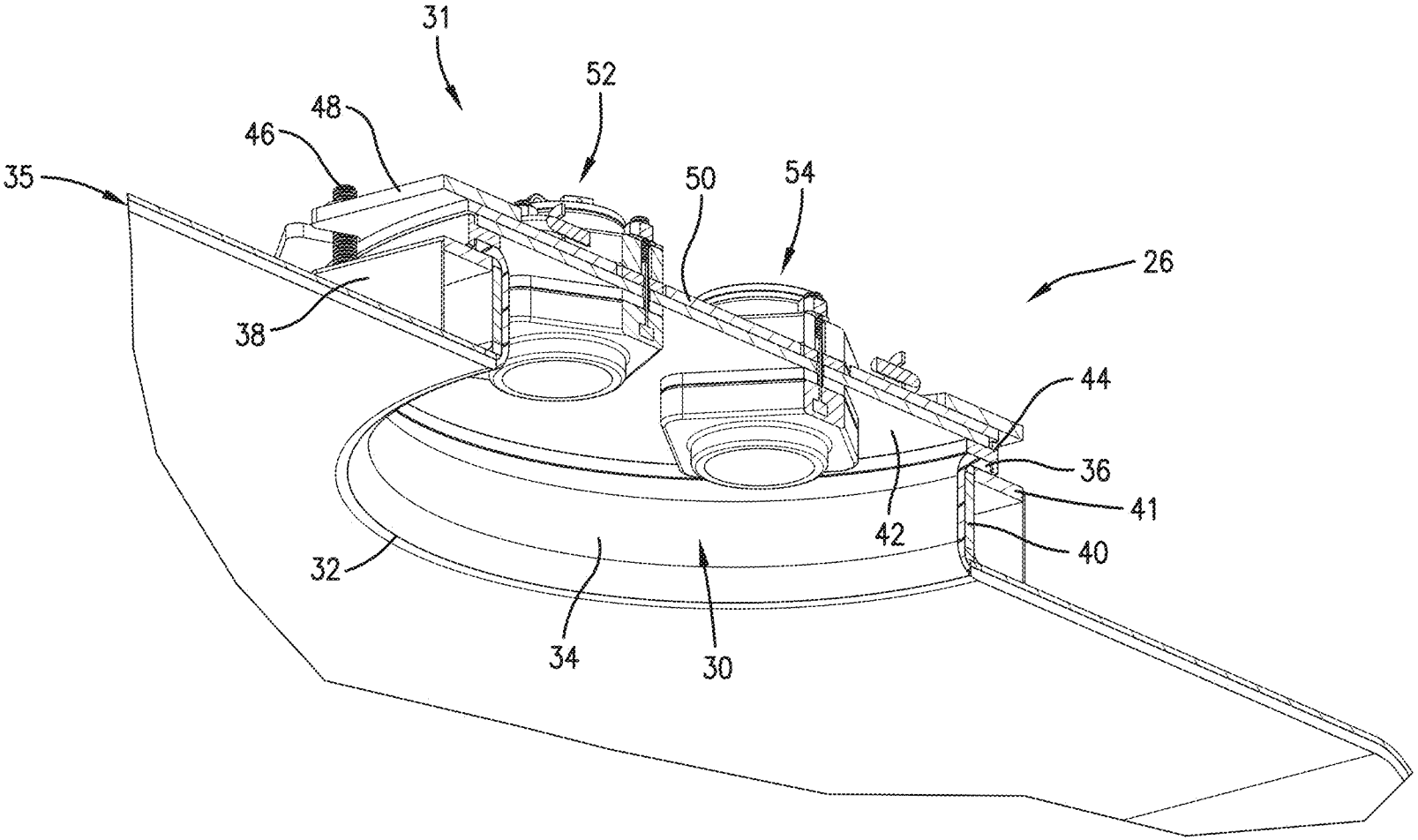
FIG. 2 is a partial sectioned perspective view of a manway assembly of the tank of FIG. 1, taken along a centerline of the manway assembly.

FIG. 2 illustrates manway assembly 26 and a portion of top 14 in greater detail. Top 14 includes an annular neck 40 having a collar 41 along its top (essentially, an outturned flange). Manway assembly 26 is secured to the collar 41 using fasteners 46 (nuts and bolts). It is foreseen that other common fasteners, such as clips or the like, may be used to secure the manway assembly 26 to the top 14 without departing from the spirit of the present inventive concept. Tank 10 further includes a guard 38 inserted below collar 41 for deflecting straps or various lifting or directional equipment or the like and preventing snagging along the collar 41.

Manway assembly 26 encloses access port or manway opening 30. Access port 30 is defined by parts of a liner 35 that cover the inside of neck 40; more specifically by inner radius 32 and substantially vertical inner surface 34. In other embodiments, such as tanks at earlier stages in the tank fabrication process that have not yet received a liner, the access port may be defined by an inner surface of the neck without departing from the spirit of the present inventive concept.

Liner 35 also includes a portion that partly covers the top surface of collar 41. In the illustrated (trimmed and finished) tank of FIG. 2, this portion of the liner 35 forms a sealing surface 36.

The manway assembly 26 includes three ducts—only two of which are shown in FIG. 2, identified by the numerals 52 and 54. Ducts 52, 54 are specially configured and constructed to exhibit certain properties inside the tank 10. In fact, the liner 35, inner layer 42, and with various gaskets and other components of the tank 10 having interior-facing surfaces, are preferably all selected based on a preference for one or more such properties. For example, the ducts 52, 54 may be constructed from thermoplastic and/or from other materials exhibiting resistance to corrosion from exposure to contents of tank 10. It is foreseen that more or fewer ducts may be provided with a manway assembly, with or without varying sizes, without departing the spirit of the present inventive concept.

Manway assembly 26 also includes a manway cover 31 having an inner layer or plate 42, backing plate 50 and securement flange 48. Inner layer or plate 42 is fixed to rigid backing plate 50. Backing plate 50 is also fixed along its extremities to securement flange 48. Securement flange 48 includes engagement slots through which fasteners 46 pass and around which they are secured, the other ends of such fasteners 46 being secured to collar 41 as discussed above. Securement flange 48 also serves as structural reinforcement for the rest of the manway cover 31.

The backing plate 50 and securement flange 48 are preferably constructed from the same material as shell 12, though it is envisioned that other rigid materials may be used without departing from the spirit of the present inventive concept, with such materials being selected by employing similar principles to those referenced herein for use in selecting a rigid material for the shell. Inner layer 42, like liner 35, is preferably selected for its durability and resistance to any corrosive effects of the tank's contents, also as described or referenced elsewhere herein.

Inner layer 42 has an inner surface that forms a seal with sealing surface 36 at a manway gasket 44. Manway gasket 44 may be in the shape of a "T", with its stem sandwiched between inner layer 42 and sealing surface 36, and with its top wrapping around the perimeters of the inner layer 42 and sealing surface 36 to form a better seal. Manway gasket 44 may be formed of similar material to the inner layer 42 and/or liner 35, such as an elastomeric material/plastic, again selected by taking into account compatibility with, and resistance to, corrosion from contact with contents of tank 10.

Figure 3:
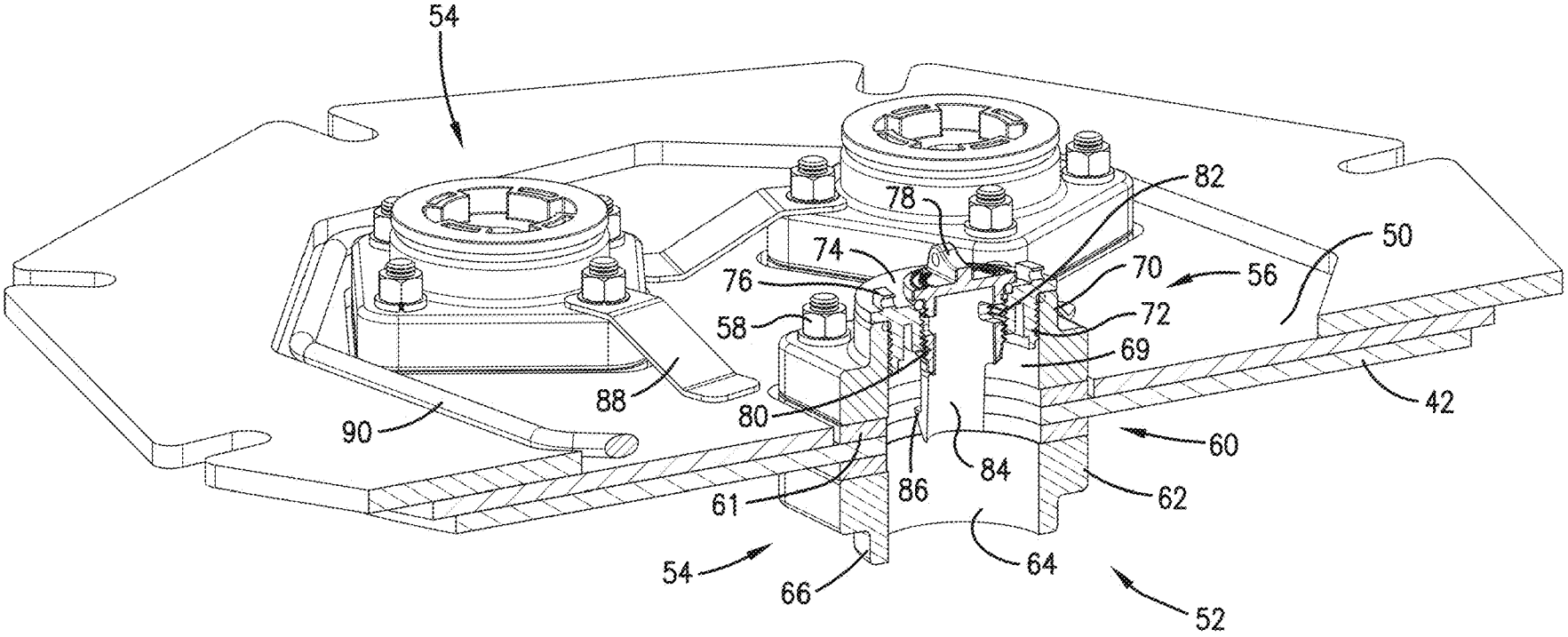
FIG. 3 is a partial sectioned perspective view of the manway assembly of the tank of FIG. 1, taken through a duct embedded in a manway cover that includes a first type of vent.

FIG. 3 illustrates a sectioned manway assembly 26 taken along a centerline of a duct 52 that defines a vent passage passing through the manway cover 31. Duct 52 includes upper and lower fittings 56, 62 secured together by mechanical fasteners 58 (illustrated as nuts and bolts). The vent passage is defined at least in part by inner surfaces 64, 69 of, respectively, lower and upper fittings 62, 56.

Four fasteners 58 secure the fittings 56, 62 of duct 52. Each fastener 58 is embedded within the lower fitting 62, preferably without being exposed to the interior of the tank 10, provided however that such exposure may be acceptable in alternative embodiments, particularly where the fastener is constructed of a material selected to be compatible with contents of tank 10. Each fastener 58 includes a bolt that extends up through the lower fitting 62, through an interior duct gasket 60, through the inner layer 42, through an exterior duct gasket 61, and finally through upper fitting 56 to be secured by a nut along its top surface. It is noteworthy that backing plate 50 is recessed from the juncture of inner layer 42 with duct gaskets 60, 61; among other things, this permits the seal at this juncture to avoid participation from the rigid (e.g., metal) backing plate 50, which may not be constructed of materials that exhibit desirable characteristics for facing the interior of the tank 10. Ducts 52, 54 are secured to backing plate 50 using retainer clips 88, which are shown with top ends secured by a bolt along upper fittings and bottom ends fixed to backing plate 50.

Interior and exterior duct gaskets 60, 61 may be made of similar materials, such as elastomeric materials, as manway gasket 44, or from other similar materials known for use as gaskets; it is preferable that at least interior duct gasket 60 be selected for compatibility with contents of tank 10.

Duct 52 includes a mechanical vent 78. Mechanical vent 78 includes a vent cap 74 having internal threading 82 to receive a central relief plug 80, which has threading on its external surface. Preferably, an o-ring or similar gasket is incorporated adjacent an upper segment of the interface between the vent cap 74 and relief plug 80 to facilitate the threaded seal. The mechanical vent 78 may as a whole be threaded into an internal threaded portion 72 of the upper fitting 56, for example by grasping lug 76 along the top of vent cap 74 to rotate the mechanical vent 78. Preferably, an o-ring or similar gasket is incorporated adjacent an upper segment of the interface between the mechanical vent 78 and upper fitting 56 to facilitate the threaded seal.

In this manner, relief plug 80 may be rotated within vent cap 74 to tighten or loosen the seal and permit ventilation of the interior of tank 10. Further, relief plug 80—once threaded below a certain height within vent cap 74—will preferably be prevented from removal by a catch 86 extending perpendicularly from flange or bayonet 84. The catch 86 will engage a lower segment of the internally threaded portion of the vent cap 74 if relief plug 80 is unscrewed too much to prevent further rotation in that direction.

In addition, a tamper evident line or the like may be threaded through the eye at the top of relief plug 80 to make evident any attempts to unscrew the relief plug 80. Also, a lower portion of inner surface 64 and/or outer rim 66 of lower fitting 62 may be threaded or otherwise configured to receive an interior-facing peripheral component, such as a dip tube or fluid directing device, without departing from the spirit of the present inventive concept. Finally, a handle 90 is rotatably secured to backing plate 50 to permit easy lifting and lowering of the manway assembly 26.

Figure 4:
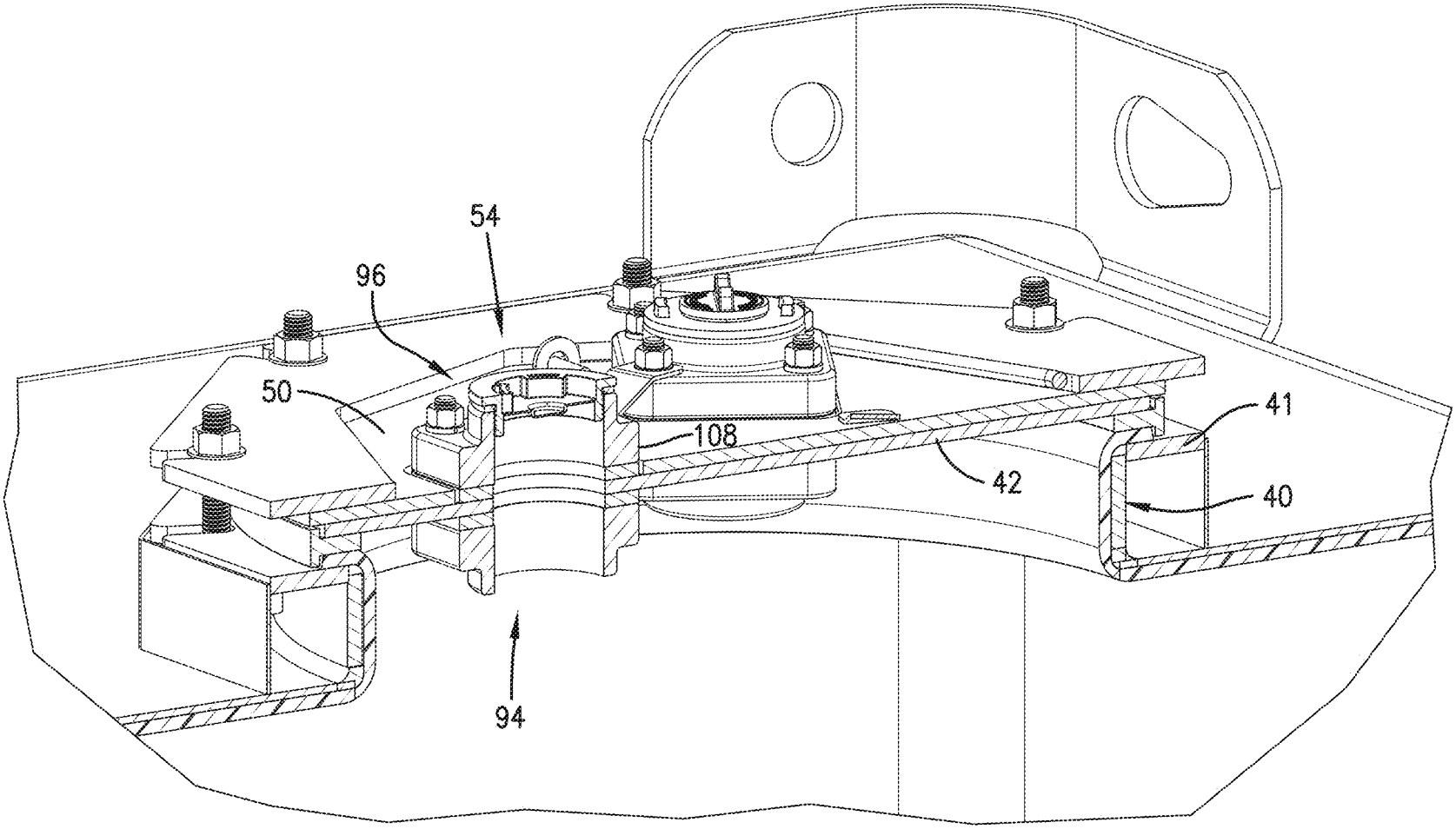
FIG. 4 is a partial sectioned perspective view of the manway assembly of the tank of FIG. 1, taken through a duct embedded in the manway cover that includes a second type of vent.

FIG. 4 illustrates a sectioned manway assembly 26 taken along a centerline of a duct 54 that defines a vent passage passing through the manway cover 31. Upper and lower fittings 108, 94 and associated components are constructed similarly to the analogous components of duct 52 discussed above. However, instead of mechanical vent 78, a plug 96 is threaded into upper fitting 108. Plug 96 may be removed for manual access to the interior of the tank.

Figure 5:
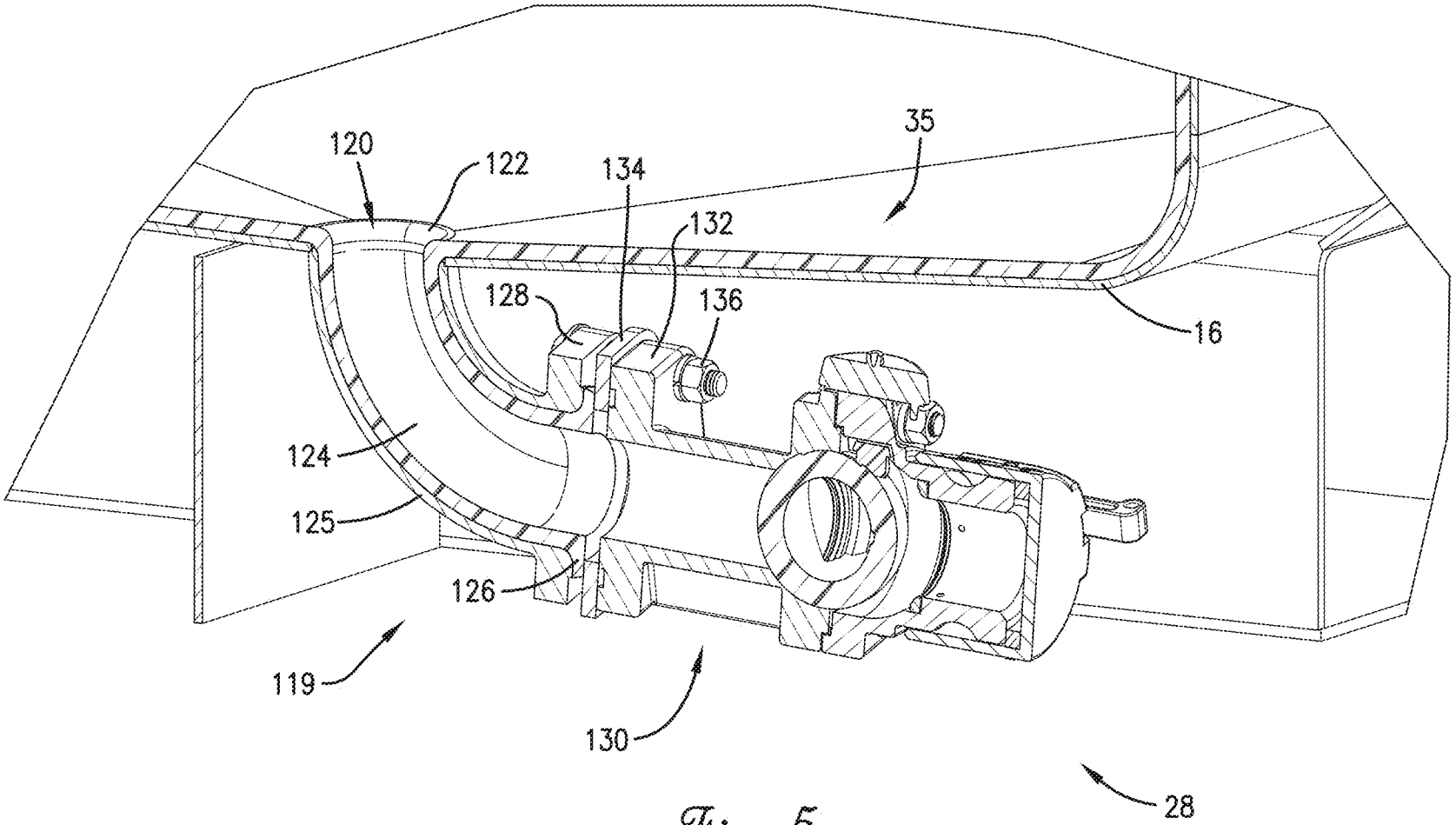
FIG. 5 is a sectioned perspective view of an outlet port and cover of the tank of FIG. 1, taken through a centerline of the outlet port and cover.

FIG. 5 illustrates an embodiment of outlet port 119 secured to an outlet cover 28 including a ball valve assembly 130. Ball valve assembly 130 is secured to a collar 128 of tube 125 of outlet port 119. Preferably, the ball valve assembly 130 is constructed from a material, such as a thermoplastic, selected for its durability and resistance to corrosive tendencies of contents of tank 10.

Outlet port 119 includes an outlet passageway 120 defined by portion 122, 124 of liner 35 that cover interior surfaces of tube 125. In other embodiments, such as tanks at earlier stages in the tank fabrication process that have not yet received a liner, the outlet passageway may be defined by an inner surface of the tube without departing from the spirit of the present inventive concept. Liner 35 also includes a portion that extends over and partially covers collar 128. As illustrated (finished and trimmed), this portion of the liner 35 comprises a sealing surface 126 (see also FIG. 10).

Fasteners 136 secure a base 132 of ball valve assembly 130 to collar 128. Sandwiched between base 132 and collar 128 is an outlet gasket 134, which helps form the seal along the outlet port 119. Preferably, the outlet gasket 134 may be formed of similar material to the inner layer 42 and/or liner 35, and/or manway gasket 44, such as an elastomeric material/plastic, again by taking into account compatibility with and resistance to corrosion from contact with contents of tank 10. In other embodiments, outlet gasket 134 may have an inner radius substantially equal to the inner radius of outlet passageway 120.

Figure 6:
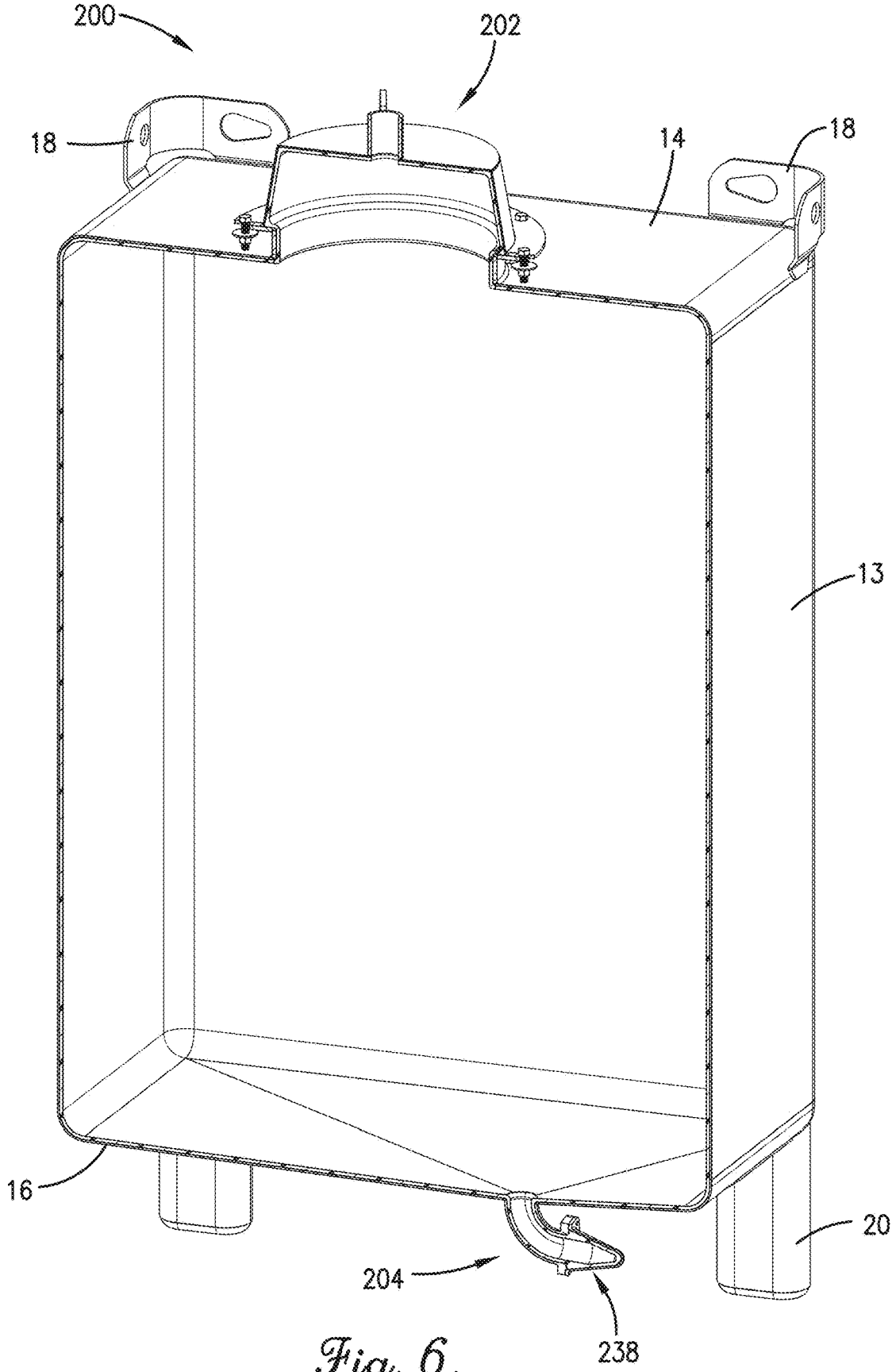
FIG. 6 is a cross-sectional view of an intermediate stage tank, taken through a centerline of the tank and illustrating frustoconical and conical caps respectively secured to neck and tube, and illustrating thickened annular segments adjacent joints therebetween.

FIG. 6 illustrates an intermediate-stage tank 200 to be configured for use in bulk material storage and transport. Tank 200 includes a frustoconical cap 202 secured to top 14, and a conical cap 238 secured to outlet port 204.

Figure 7:
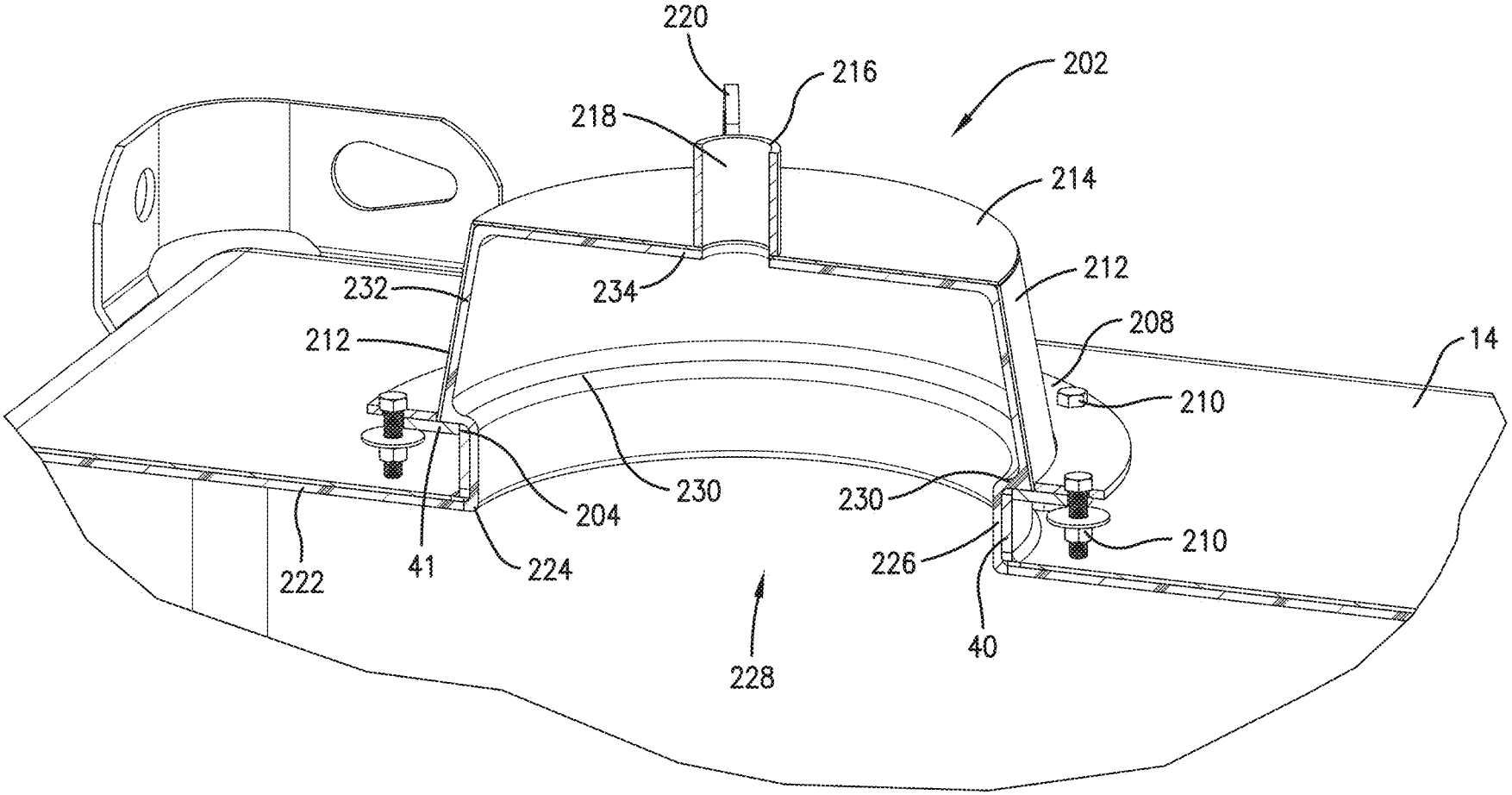
FIG. 7 is a partial view of the illustration of FIG. 6, illustrating in greater detail the frustoconical cap and adjacent thickened annular segment.

FIG. 7 illustrates additional detail for frustoconical cap 202 and top 14. Frustoconical cap 202 encloses access port 228 and is secured along a brim 208 to collar 41 using fasteners 210. Access port 228 is defined by parts of a liner 222 that cover the inside of neck 40; more specifically by inner radius 224 and substantially vertical inner surface 226 of liner 222. In other embodiments, such as tanks at earlier stages in the tank fabrication process that have not yet received a liner, the access port may be defined by an inner surface of the neck without departing from the spirit of the present inventive concept.

Liner 222 also includes an annular thickened segment 230 at the joint between the frustoconical cap 202 and the collar 41. In the illustrated tank 200 of FIG. 7, this annular thickened segment 230 of the liner 222 is untrimmed and unfinished, having yet to be formed into a sealing surface for later use in sealing against a manway gasket and/or manway assembly.

Liner 222 is applied to tank 200 using common methods. The liner 222 is preferably rotationally molded and unitarily formed of one piece plastic construction. The liner 222 is preferably formed or molded using a plastic resin material. For example, the liner 222 may be formed of polyethylene. However, the container could be formed of other materials without departing from the spirit of the present inventive concept. Likewise, the liner 222 may include one or more wall thickness(es) that may be selected by one having ordinary skill to optimize durability and resistance to corrosion in various applications, for example to account for stored materials or chemicals across various applications and pH and toxicity ranges.

Frustoconical cap 202 is instrumental in proper formation of liner 222 to ensure that the tank 200 may be further configured for use in storage and transport, particularly of chemicals, in bulk. The lower inside diameter of frustoconical cap 202 is configured to abut collar 41 during the lining process and form an outer radius that annular thickened segment 230 builds or "thickens" inward from. The lower inside diameter of frustoconical cap 202, when centered on collar 41, is preferably sized to permit about thirty percent (30%) or more of the interior of the top surface of the collar 41 to receive the annular thickened segment 230 and/or the liner 222 more generally. However, it is also preferred that the outer radius of the annular thickened segment 230—and likewise the lower inside radius of frustoconical cap 202—be kept inside the bolt holes through which fasteners 210 extend (thus preventing the liner 222 from obstructing the bolt holes), thereby forming a "raised face" flange or the like.

Moreover, the angle formed by a wall 212 of the frustoconical cap 202 with the top surface of the collar 41 plays an important role in formation of the annular thickened segment 230 of tank 200. A relatively large angle is preferably selected to prevent void development along the lower inside radius of frustoconical cap 202. However, some inward incline of wall 212 is also preferred, at least to permit separation of the frustoconical cap 202 from a wall and top 232, 234 of the liner 222 after it has hardened/cured. Therefore, it is preferred that the angle formed between wall 212 and the top surface of the collar 41 (at their juncture) be between about sixty degrees (60°) and about eighty degrees (80°). An inner surface of wall 212 may additionally be treated with a chemical to reduce adhesion between such inner surface and the liner 222.

In addition, the height of frustoconical cap 202 is preferably at least sufficient to prevent "bunching" or excessive thickening of the annular thickened segment 230 during formation of liner 222. Moreover, the height of frustoconical cap 202 is preferably selected to aid in the machining process to trim and finish the annular thickened segment 230 to form a sealing surface; i.e., to allow liner 222 to lay up correctly during curing and permit it to be trimmed to form a smooth sealing surface. Preferably, the height of frustoconical cap 202 is at least five (5) times the thickness of liner 222 outside of the annular thickened segments 230, 256. More preferably, the height of frustoconical cap 202 is about twenty (20) times the thickness of liner 222 outside of the annular thickened segments 230, 256. Where the liner 222 is of inconsistent thickness throughout the shell 12, the thinnest segment of the liner 222—excluding residual portions not targeted to receive lining—may be used to determine the aforementioned relationship.

Frustoconical cap 202 also includes a cylindrical vent 216 defining a ventilation shaft 218 providing fluid communication with an interior of the frustoconical cap 202. Cylindrical vent 216 includes a lifting hook 220 extending from its upper periphery and configured to aid in removing frustoconical cap 202 after curing/hardening of the liner 222.

Figure 8:
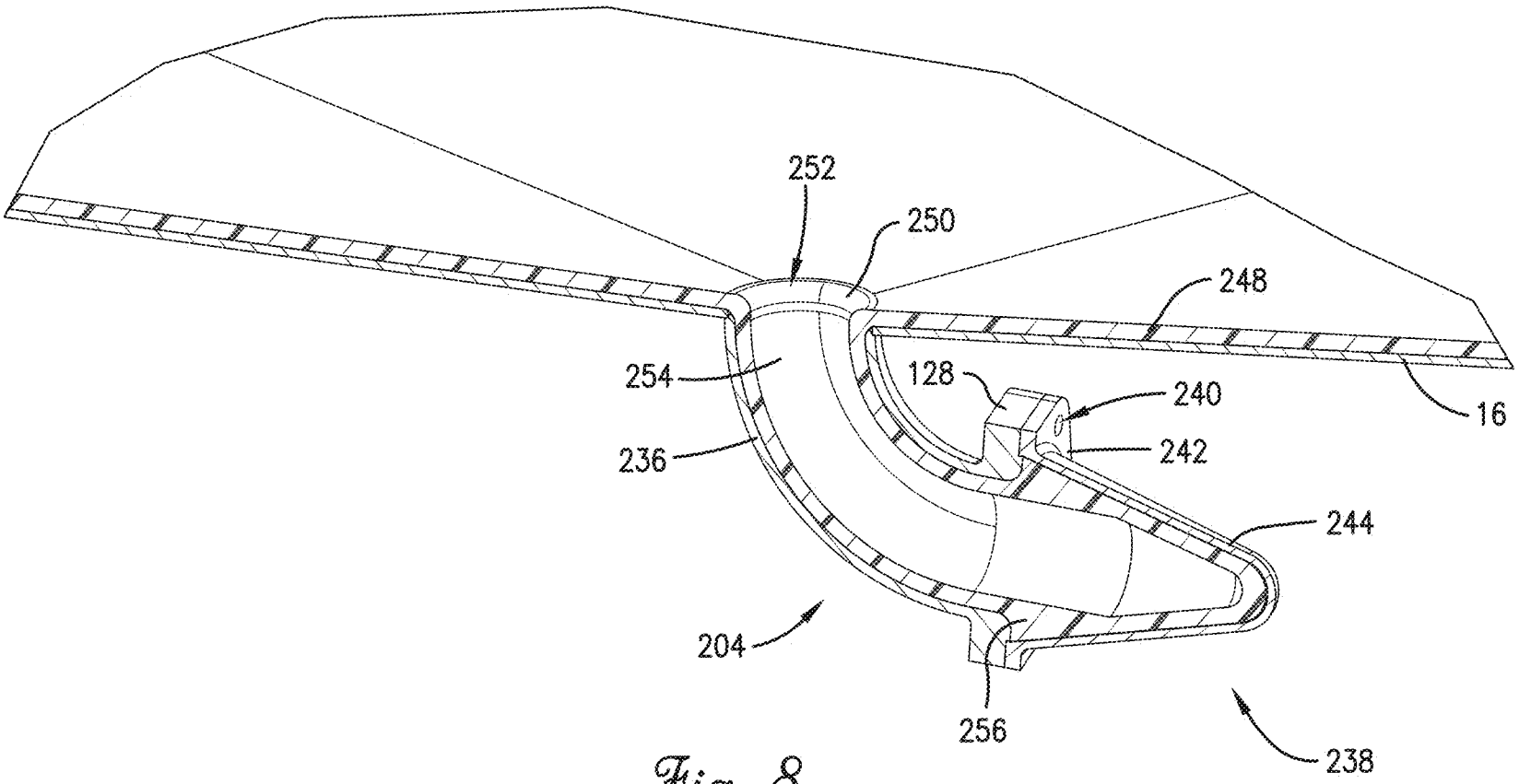
FIG. 8 is a partial view of the illustration of FIG. 6, illustrating in greater detail the substantially conical cap and adjacent thickened annular segment.

FIG. 8 illustrates additional detail for conical cap 238 and bottom 16. Conical cap 238 encloses outlet passageway 252 and is secured along a brim 242 to collar 128 using fasteners (see fasteners 136 of FIG. 5) extending through fastener holes 240 in the cap 238 and fastener holes 264 in the collar 128 (see FIG. 10). Outlet passageway 252 is defined by parts of a liner 248 that cover the inside of tube 236; more specifically by inner radius 250 and substantially elbow-shaped inner surface 254. In other embodiments, such as tanks at earlier stages in the tank fabrication process that have not yet received a liner, the outlet passageway may be defined by an inner surface of the tube without departing from the spirit of the present inventive concept.

Liner 248 also includes an annular thickened segment 256 at the joint between the conical cap 238 and the collar 128. In the illustrated tank of FIG. 8, this annular thickened segment 256 of the liner 248 is untrimmed and unfinished, having yet to be formed into a sealing surface for later use in sealing against an outlet cover, such as a ball valve assembly. The same design concerns and strategy described above in connection with frustoconical cap 202 also apply with respect to the shape and dimensions of the conical cap 238. Namely, the angle formed by a wall 244 of the conical cap 238 with an outermost surface 262 (see FIG. 10) of second collar 128 plays an important role in formation of the annular thickened segment 256. A relatively large angle is preferably selected to prevent void development along the inside radius of conical cap 238. However, some inward incline of wall 244 is also preferred, at least to permit separation of the conical cap 238 from the liner 222 after it has hardened/cured. Therefore, it is preferred that the angle formed between wall 244 and the outermost surface of the collar 128 (at their juncture) be between about sixty degrees (60°) and about eighty degrees (80°). An inner surface of wall 244 may additionally be treated with a chemical to reduce adhesion between such inner surface and the liner 222.

In addition, the height of conical cap 238 is preferably at least sufficient to prevent "bunching" or excessive thickening of the annular thickened segment 256 during formation of liner 222. Moreover, the height of conical cap 238 is preferably selected to aid in the machining process to trim and finish the annular thickened segment 256 to form a sealing surface; i.e., to allow liner 222 to lay up correctly during curing and permit it to be trimmed to form a smooth sealing surface. Preferably, the height of conical cap 238 is at least five (5) times the thickness of liner 222 outside of the annular thickened segments 230, 256. More preferably, the height of conical cap 238 is about twenty (20) times the thickness of liner 222 outside of the annular thickened segments 230, 256. Where the liner 222 is of inconsistent thickness throughout the shell 12, the thinnest segment of the liner 222—excluding residual portions not targeted to receive lining—may be used to determine the aforementioned relationship.

FIG. 9 illustrates a finished/trimmed sealing surface 36, prior to assembly with a manway assembly. FIG. 10 illustrates a finished/trimmed sealing surface 126, prior to assembly with a ball valve assembly or the like.

A method for producing a finished tank according to embodiments of the present inventive concept includes providing a tank having a shell. The shell has a sidewall, a neck that includes a first collar, and an outlet port that includes a tube having a second collar. The method further includes applying a liner to the shell so that the liner substantially covers interior surfaces of the sidewall, top and bottom, including covering at least a portion of the first collar and at least a portion of the second collar. The step of applying the liner may include inserting a powdered resin into the tank and closing the tank by securing a frustoconical cap and a conical cap, respectively, to first and second collars. The application of the liner may further include inserting the tank into an oven and heating same for a pre-determined period of time; this step may also involve forming a vent in the liner material near a top segment of the frustoconical cap to permit ventilation of the interior of the tank during/after heating. It is foreseen that known rotational molding techniques may be used with certain embodiments without departing from the spirit of the present inventive concept.

The method further includes, after the liner has cured/hardened, trimming away at least a portion of an annular thickened segment at each of an interior joint between the frustoconical cap and the first collar, and an interior joint between the substantially conical cap and the second collar. The trimming step forms first and second sealing surfaces of the liner adjacent respectively to the first and second collars, the first and second sealing surfaces being respectively configured to substantially seal against a manway cover and an outlet cover. One method for performing the trimming step may include sawing outer segments of the liner formed adjacent the outermost portions of frustoconical and conical caps, followed by using a planer to plane a flat surface along the annular thickened segments to form sealing surfaces having substantially planar portions.

Following formation of the sealing surfaces, manway assemblies and/or outlet covers and/or other peripheral components may be secured against the collars of the neck and tube with greater expectation of success in forming a sealing with the shell and with greater integrity and protection against corrosion.

It is foreseen that a variety of peripheral components may be inserted into the fittings of the manway assembly and/or may be secured to the collar of the outlet port (i.e., to replace the illustrated ball valve assembly) without departing from the spirit of the present inventive concept.

The shell may be constructed from stainless steel, carbon steel, or similar metal alloys. It is foreseen that the shell may also be constructed of other rigid materials as may be selected by one of ordinary skill without departing from the spirit of the present inventive concept. Such materials may be selected to provide resistance to fracture and flexing to maintain the tank's shape and integrity against internal pressures exerted by the stored material, as well as against environmental forces such as those resulting from asymmetrical storage, falls onto the tank's sidewall or top, or impacts such as from errantly-placed forklift forks. Such materials may additionally be selected for corrosion resistance properties. Moreover, the thickness of the shell may be varied according to known principles for optimizing these and similar properties of storage tanks without departing from the spirit of the present inventive concept. Preferably, the thickness of the shell will be variable to achieve tank storage capacities of between one hundred (100) and five hundred (500) gallons.

During fabrication, the tank, sidewall, top, neck, bottom, outlet port, lift lugs, legs, pockets and other rigid components are preferably welded together using a known robotic manufacturing process to ensure consistent high weld quality. However, other known fabrication processes may be used without departing from the spirit of the present inventive concept.

It is foreseen that tanks according to embodiments of the present inventive concept may include additional peripheral components, whether or not fixed to the manway cover or the wall of the tank or other component, without departing from the spirit of the present inventive concept. For example, additional instrumentation such as temperature or pH measurement devices and/or additional valves or the like may be embedded in the sidewall of a tank. Further, temperature control and/or circulation or transfer conduits may be configured to flow fluid or electrical current through the interior cavity of a tank without departing from the spirit of the present inventive concept. It is preferable that portions of such additional peripheral components that are exposed to the interior cavity of the tank be non-metal or otherwise resistant to corrosion, in keeping with the objectives set forth herein.

Although the above description presents features of preferred embodiments of the present invention, other preferred embodiments may also be created in keeping with the principles of the invention. Furthermore, these other preferred embodiments may in some instances be realized through a combination of features compatible for use together despite having been presented independently in the above description.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention set forth in the following claims.

What is claimed is:

1. A storage tank comprising:

a shell including a sidewall, top and bottom defining an interior cavity, the top having a first collar and the bottom having a second collar;

a liner covering interior surfaces of the sidewall, top and bottom and including a first collar portion extending along an outer surface of the first collar and a second collar portion extending along an outer surface of the second collar;

a manway cover fastened to the first collar over the first collar portion of the liner, the manway cover having at least two layers including a first, inner layer presenting an interior-facing surface constructed of thermoplastic material and a second, outer layer comprising a backing plate constructed of a metal;

a duct having an upper and a lower fitting secured together about the first, inner layer, wherein the backing plate is recessed from a juncture between the duct and the first, inner layer;

an outlet cover fastened to the second collar over the second collar portion of the liner; and a plurality of fasteners, said first collar defining a first plurality of holes, the first plurality of holes receiving corresponding fasteners of the plurality of fasteners that fasten the manway cover to the first collar, said second collar defining a second plurality of holes, the second plurality of holes receiving corresponding fasteners of the plurality of fasteners that fasten the outlet cover to the second collar, said first plurality of holes extending outward beyond said first collar portion of the liner, said second plurality of holes extending outward beyond said second collar portion of the liner.

2. The tank of claim 1, wherein a manway gasket is secured between the manway cover and the first collar portion of the liner, and an outlet gasket is secured between the outlet cover and the second collar portion of the liner.

3. The tank of claim 2, wherein each of the liner, the manway gasket and the outlet gasket is constructed of thermoplastic material.

4. The tank of claim 1, wherein the duct is constructed at least partly of thermoplastic material.

5. The tank of claim 1, wherein at least one duct gasket is fixed between the upper fitting and the lower fitting.

6. The tank of claim 5, wherein the upper fitting, the lower fitting, and the at least one duct gasket are at least partly constructed of thermoplastic material.

7. The tank of claim 6, wherein the upper fitting and the lower fitting are secured together using a bolt embedded within the lower fitting that does not extend into the interior cavity.

8. The tank of claim 1, wherein the duct defines a vent passage through the manway cover for selective ventilation of the tank, the duct forming a seal against the inner layer at interior and exterior gaskets.

9. The tank of claim 1, further comprising a manway gasket at an interface between the manway cover and the first collar portion of the liner.

* * * * *